US006826124B2

(12) United States Patent
Born

(10) Patent No.: US 6,826,124 B2
(45) Date of Patent: Nov. 30, 2004

(54) TIMEPIECE WITH POWER RESERVE INDICATION

(75) Inventor: Jean-Jacques Born, Morges (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 10/702,576

(22) Filed: Nov. 7, 2003

(65) Prior Publication Data

US 2004/0109390 A1 Jun. 10, 2004

(30) Foreign Application Priority Data

Dec. 4, 2002 (CH) ..... 2050/02

(51) Int. Cl.[7] ..... G04C 23/00; G04B 1/10; G04B 1/00; G04B 9/00

(52) U.S. Cl. ..... 368/66; 368/140; 368/203; 368/210

(58) Field of Search ..... 368/64, 66, 140, 368/147–152, 203, 206–210

(56) References Cited

U.S. PATENT DOCUMENTS 5,699,322 A * 12/1997 Born ..... 368/66
5,751,666 A * 5/1998 Farine et al. ..... 368/140
6,208,119 B1 * 3/2001 Schafroth ..... 322/29
6,678,218 B2 * 1/2004 Serex et al. ..... 368/160

FOREIGN PATENT DOCUMENTS

| | | |
|---|---|---|
| CH | 686 332 A3 | 3/1996 |
| EP | 1 109 083 A1 | 12/1989 |
| EP | 762 243 A1 | 3/1997 |

* cited by examiner

*Primary Examiner*—Vit W. Miska
(74) *Attorney, Agent, or Firm*—Sughrue Mion, PLLC

(57) ABSTRACT

The present invention concerns a timepiece including a barrel, a spring housed in the barrel, time display members mechanically coupled to said barrel, an electric energy generator also coupled to said barrel, and a regulator circuit for enslaving the frequency of said generator to a reference frequency. The regulator circuit includes for this purpose switching means arranged for electrically braking said generator during braking periods, when said regulator circuit detects that the frequency of said generator is higher than the reference frequency. The generator controls actuating means of an analogue power reserve member, via an electric quantity transmitted by electric coupling between the actuating means and the generator, during said braking periods.

11 Claims, 6 Drawing Sheets

Wound spring
frequent short-circuits

Less frequent
short-circuits

Let down spring
no short-circuits

TIMEPIECE WITH POWER RESERVE INDICATION

FIELD OF THE INVENTION

The present invention concerns a timepiece having a generator with power reserve indication.

Such a timepiece includes a barrel, in which is housed a spring. Time display members are mechanically coupled to the barrel, as well as an electric energy generator. A regulator circuit is intended to enslave the generator frequency to a reference frequency. Thus the regulator circuit includes switching means arranged for electrically braking the generator during braking periods, when the regulator circuit detects that the generator frequency is higher than the reference frequency.

DESCRIPTION OF THE RELATED ART

Such a timepiece, shown in FIG. 1, is known from the prior art, particularly from EP Patent No. 0 762 243 in the name of the present Applicant. The timepiece includes a mechanical energy source, formed by a barrel 1 in which a spring 1*a* is housed, manually or automatically wound, the winding device not being shown here.

Barrel 1 is mechanically coupled to the magnetised rotor 2*a* of an electric generator 2 via gear trains 3. Generator 2 includes at least one coil 2*b*, from which an alternating voltage Ug is generated, when magnetised rotor 2*a* is driven in rotation, generating a magnetic field symbolised by means of an arrow and to which said at least one coil 2*b* is coupled.

The terminals of coil 2*b* (or coils) are connected to a rectifier 4 supplying at output a rectified voltage Ua, for powering regulator circuit 6, which will be examined hereinafter.

Analogue display members of a time-related indication 5, typically a set of hands or any other conventional mechanical time display means, are mechanically coupled to the barrel through gear trains 3 of the movement and are secured in rotation to rotor 2*a*. The rotational speed of hands 5 is kept at a constant mean value owing to regulator circuit 6, which is for enslaving the generator frequency to a reference frequency, such that the speed of the hands corresponds to the speed required to obtain a correct time indication.

This regulator circuit 6 will not be described in detail here, since those skilled in the art can construct such an enslaving device by referring to the description in Swiss Patent Application No. 686 332 in the name of the present Applicant. However, in order to facilitate comprehension of said circuit, its essential elements and working will be recalled here.

This regulator circuit 6 includes an oscillator 6*a* stabilised by a clockwork type quartz and a frequency divider 6*b* bringing the frequency of the oscillator 6*a* to a frequency that can be used by a logic circuit 6*c* which, by means of a control signal, controls a switching member 7, for example a transistor, in order to brake generator 2 for the purpose of regulating its frequency to the level of a reference frequency advantageously corresponding to a correct time indication by the display members of time indication 5.

The timepiece according to this Patent document also includes a power reserve indicator device 9. This device includes a counter 9*a* keeping account of the successive braking signals 8 during a determined time period by means of an additional frequency divider 9*b*. A memory 9*c* is connected to the output of counter 9*b* so as to store the counted data during the determined time period, at the output of which there is connected a decoder 9*d* converting the stored data into a control signal for incremental display means 9*e* of power reserve 17, achieved by means of a coloured strip, or a liquid crystal cell. "Incremental display means" means a display 9*e* including successive marks which are illuminated or appear up to the point corresponding to the value of the quantity being measured or calculated.

One of the main advantages of a timepiece having a generator, is that the use of a traditional mechanical watch movement can be reconciled with quartz precision.

This is why, the solution recommended in EP Patent No. 0 762 243, although working in a suitable manner, nonetheless has the drawback of using incremental display means for the power reserve controlled by an indicator device essentially formed by electronic elements that are additional to those necessary for the working of the regulator circuit. Moreover, these additional electronic elements have the effect of increasing the global consumption of the electronic circuit, which may prove harmful to the accuracy of the time indication.

Further, a solution that consists in integrating a conventional power reserve indication device has the drawback of not using the indications provided during operation of the generator and particularly during the braking periods of the latter.

In order to overcome the drawbacks of the prior art, the idea according to the invention is to provide an analogue power reserve indication while using the indications linked to the operation of the generator without increasing the electric power consumption of the timepiece.

SUMMARY OF THE INVENTION

The invention therefore concerns a timepiece of the type defined in the preamble of the description, characterized in that the generator controls means for actuating an analogue power reserve member, via an electric quantity transmitted by electric coupling between the actuating means and the generator, during the braking periods.

According to an advantageous embodiment, the actuating means include a stator and a rotor, and are electrically coupled to the generator via the stator, the latter also being magnetically coupled to the rotor which moves the analogue power reserve display member mechanically between a first position corresponding to the spring being wound to a second position corresponding to the spring being let down.

BRIEF DESCRIPTION OF THE DRAWINGS

Other features and advantages of the invention will appear during the following description, given solely by way of example and made with reference to the annexed drawings, in which.

DESCRIPTION OF THE PREFERRED EMBODIMENTS

Figure 1:
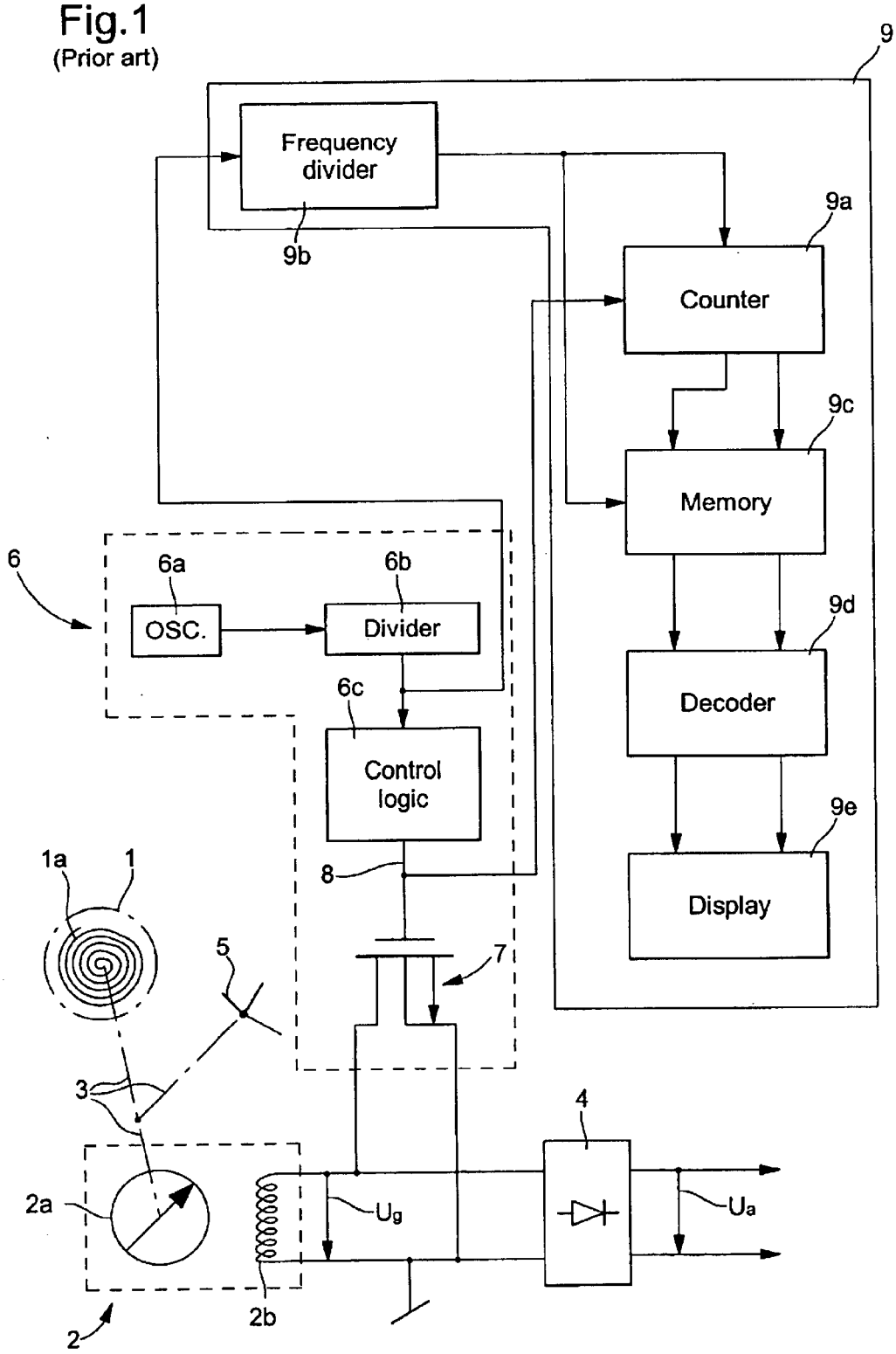
Fig.1 (Prior art)
FIG. 1, already described, shows a simplified diagram of a timepiece according to the prior art.
Figure 2:
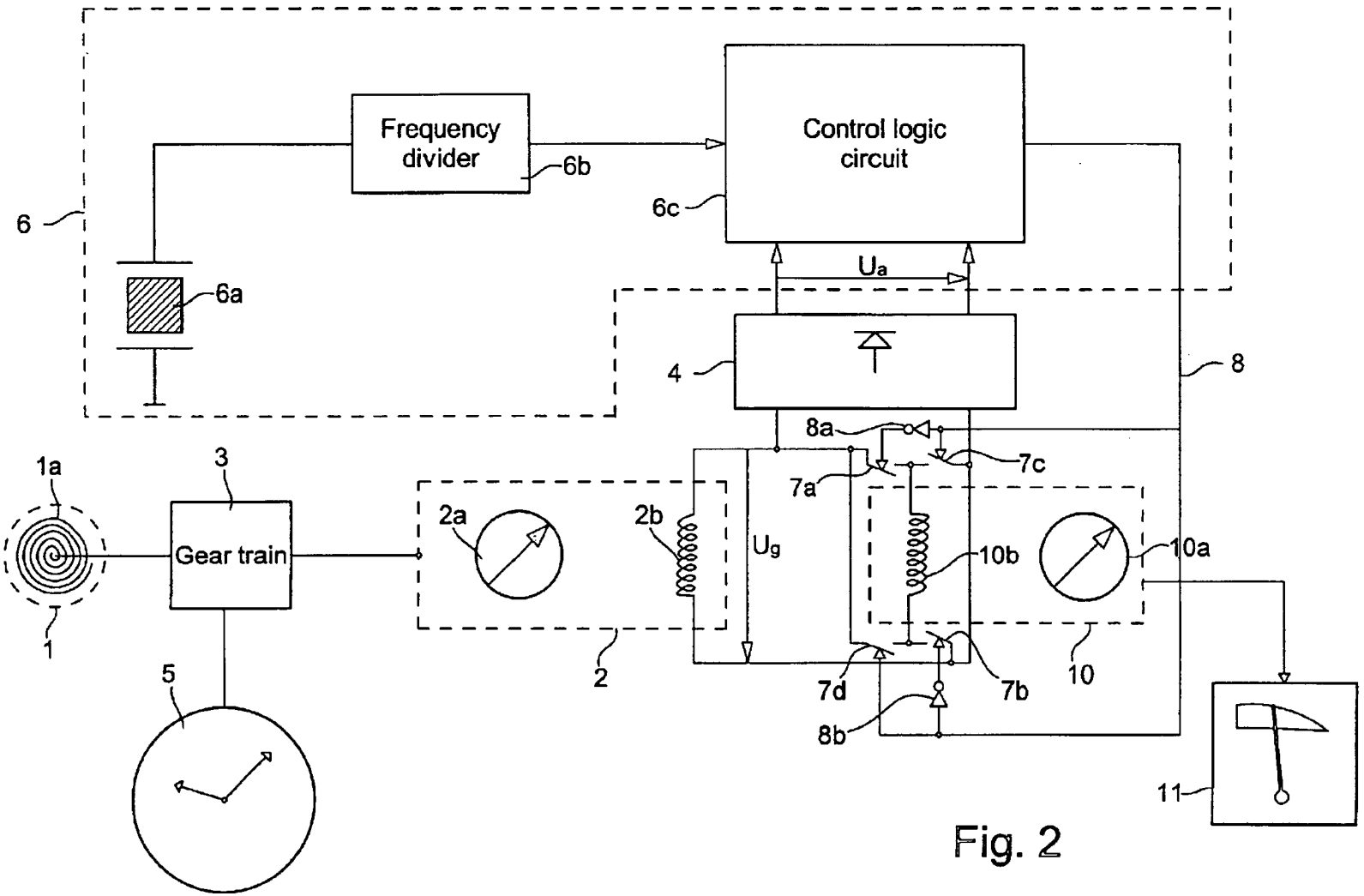
FIG. 2 shows a general simplified diagram of a timepiece according to a preferred embodiment of the invention.

Reference will now be made to FIG. 2, which shows a simplified diagram of a timepiece according to a preferred embodiment of the invention. A certain number of elements can be seen that are the same as those presented in connection with FIG. 1 of the prior art, which will not be explained again and whose references have been kept the same.

As was mentioned in the prior art presented hereinbefore, generator 2 is braked during braking periods, when regulator circuit 6 detects that the generator frequency is higher than a determined reference frequency. The voltage Ug across the terminals of coil 2*b* of the generator, shown in FIG. 3A, is an alternating voltage, wherein the braking periods of the coil are represented by the zones marked f1, f2 and f3.

Figures 3A, 3B, 3C:
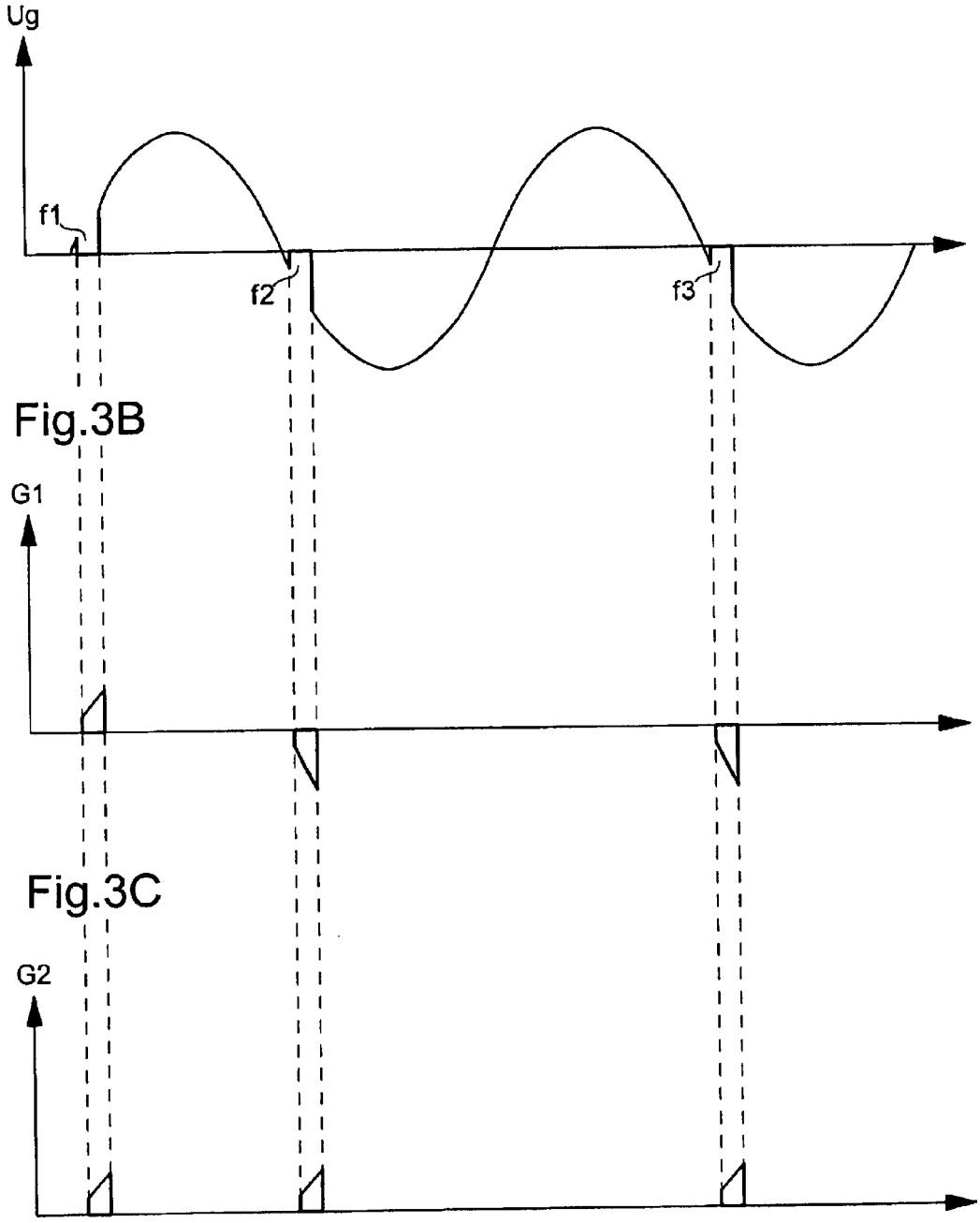
FIGS. 3A, 3B and 3C show the electric control according to the preferred embodiment of FIG. 2.

It has been demonstrated that during these generator braking periods, energy is dissipated in the coil or coils 2*b* in the form of an electric quantity G1, shown in FIG. 3B, linked to the power reserve. Indeed, when the generator is frequently braked, the mean dissipated energy is significant, which means that the remaining power reserve is significant. Conversely, when the generator is braked less frequently, the mean dissipated energy decreases and the remaining power reserve is less significant.

A power reserve indicator device is thus provided. It includes actuating means 10 actuating an analogue power reserve display member 11. These actuating means 10 are advantageously formed of an electrically controlled actuator having a stator including, in particular, a coil 10*b* and a magnetised rotor 10*a*.

The command for these actuating means 10 is transmitted by electric coupling between coils 2*b* and 10*b*, via switching means 7*a* to 7*d* in the form of an electric quantity G2 depending on electric quantity G1 dissipated during the braking periods. This electric quantity G2, which advantageously corresponds to the electric current I passing through additional coil 10*b*, not only allows actuating means 10 to be powered, but also a mean magnetic field to be induced, driving magnetised rotor 10*a* in rotation.

In the particular example of the actuator with a magnetised rotor, it is necessary to check that the mean magnetic field induced in additional coil 10*b*, is not zero. In order to do this, different variants are possible for implementing the switching means, of which two variants are given by way of example, respectively in FIGS. 2 and 7.

According to a first advantageous variant, shown in FIG. 2, an H-shaped rectifier bridge including 4 switches 7*a* to 7*d* is used as switching means.

In order to obtain a transmitted electric quantity G2, in the form shown in FIG. 3C, the 4 switches 7*a* to 7*d* are controlled by a control signal 8 delivered by regulator circuit 6, in the manner explained hereinafter.

When no braking has to be applied to coil 2*b* of the generator, the four switches 7*a* to 7*d* are in the open position, as shown, and the electric quantity transmitted to the additional coil is zero.

When braking is applied to coil 2*b*, as mentioned hereinbefore, the positive and negative alternations of electric quantity G1 can be distinguished. During positive alternations in electric quantity G1, switches 7*a* and 7*b* are simultaneously switched into the closed position, whereas at the same time, switches 7*c* and 7*d* are simultaneously switched into the open position. And, during negative alternations in said quantity G1, switches 7*a* and 7*b* are then simultaneously switched into the open position, whereas at the same time switches 7*c* and 7*d* are switched into the closed position. One can also envisage switching the switches in the opposite manner. The opposite commands, applied to switching means 7*a*–7*b* and 7*c*–7*d* are obtained via inverters 8*a* and 8*b*.

The resulting transmitted electric quantity G2 is shown in FIG. 3C. It will be noted in this regard that, according to this first variant, quantity G2 is advantageously transmitted at the time of generator braking periods, i.e. for the entire time that these periods last.

Figure 7:
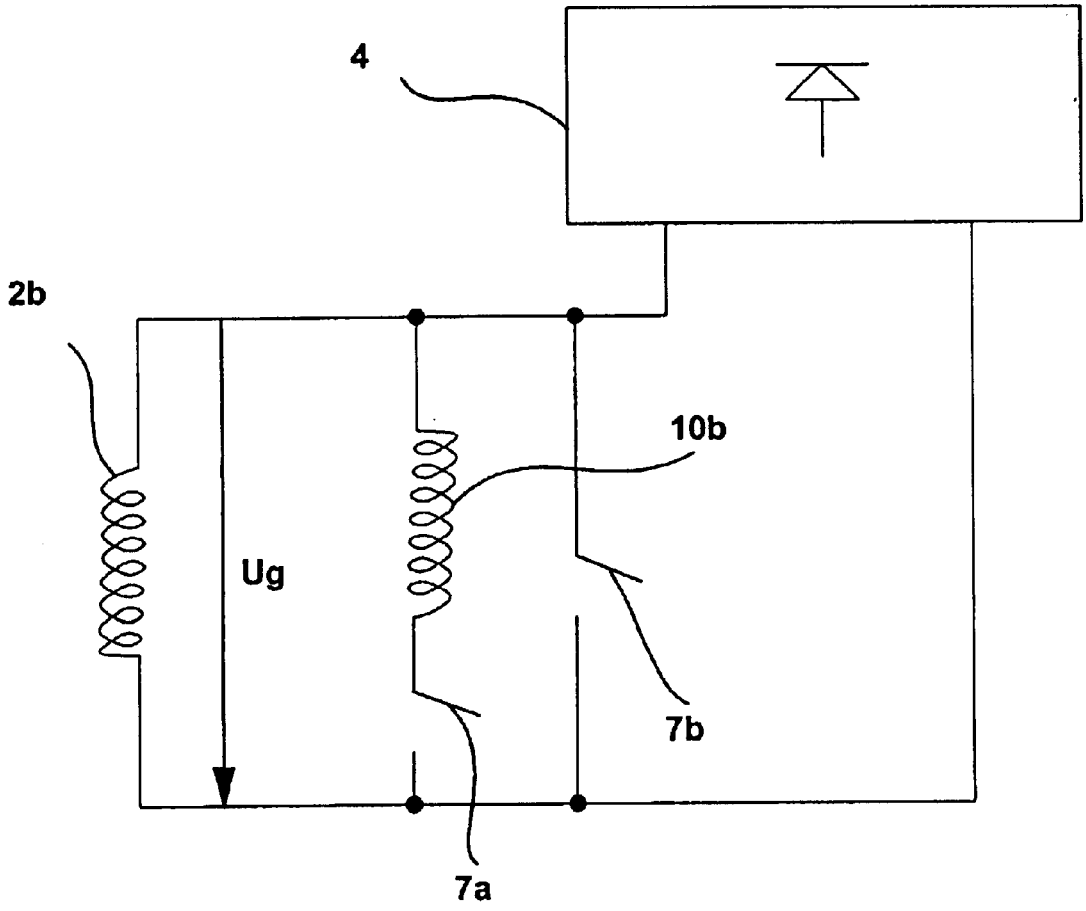
FIG. 7 shows a variant of the switching means according to the embodiment of FIG. 2.

According to a second possible variant, it is simply provided that either only the positive alternations, or only the negative alternations are transmitted to additional coil 10*b*, by using switching means including two switches, as shown in FIG. 7.

When no braking has to be applied to coil 2*b* of the generator, the two switches are then switched into the open position.

When braking is applied to coil 2*b*, the positive and negative alternations in electric quantity G1 are also distinguished. During positive alternations, one of the switches is switched into the closed position, the other being then switched into the open position. During negative alternations, the switching is thus carried out in the opposite manner. According to this variant, transmitted quantity G2 only provides data as to the power reserve during positive or negative alternations depending upon the connection adopted, during the braking periods.

It will be noted in this regard that according to this second variant, quantity G2, not shown, is transmitted during the braking periods, i.e. not necessarily for the entire time that these periods last, but for example only at the time of certain periods like the positive alternations.

Whatever the variant implemented for the switching means, magnetised rotor 10*a* is arranged to drive the display member 11 from a first position corresponding to the spring being wound, to a second position corresponding to the spring being let down. The detailed working of this power reserve indicator device is given hereinafter with reference to FIGS. 4 to 6.

Figure 4A:
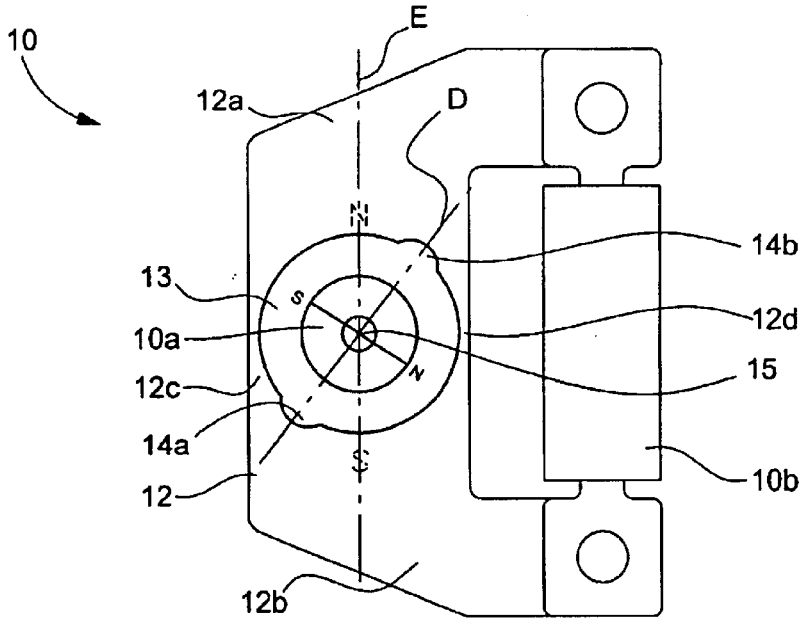
FIGS. 4A and 4B show an advantageous embodiment of the actuating means.

FIG. 4A shows a top view of an electrically controlled actuator according to a preferred embodiment of the invention.

As was mentioned hereinbefore, the actuating means include, in particular, an actuator 10 including a coil 10*b* secured to a stator 12 having a, preferably circular, cavity 13, thus delimiting first and second stator portions 12*a* and 12*b*, connected by constricted zones of material 12*c* and 12*d*, said stator portions 12*a* and 12*b* defining two opposite magnetic poles (N and S) when the coil is powered, i.e. at the time of the generator braking periods. It will be noted in this regard that the stator is advantageously formed by a material with high magnetic permeability.

Circular cavity 13 has two substantially diametrically opposite necks 14*a* and 14*b* on its periphery. The axis D defined along the diameter connecting the two necks 14*a* and 14*b* forms, for example, an angle of approximately 45° with the axis E defined along the length of stator 12.

Actuator 10 also includes a magnetised rotor 10*a*, preferably circular, centred on cavity 13 defined by stator 12 and mounted in rotation on a shaft 15. The magnetic poles (N and S) of magnetised rotor 10*a*, have been shown in the so-called rotor idle position.

"Rotor idle position" (see FIG. 6C) means the position taken by rotor 10*a* when coil 10*b* of the stator is not being powered, i.e. when the mean induced magnetic field in the coil is zero. This idle position is defined in particular, by the geometry of stator 12 and the position of necks 14*a* and 14*b*. The rotational movement of magnetised rotor 10*a* with respect to stator 12 is given in detail in FIGS. 6A to 6C.

Figure 4B:
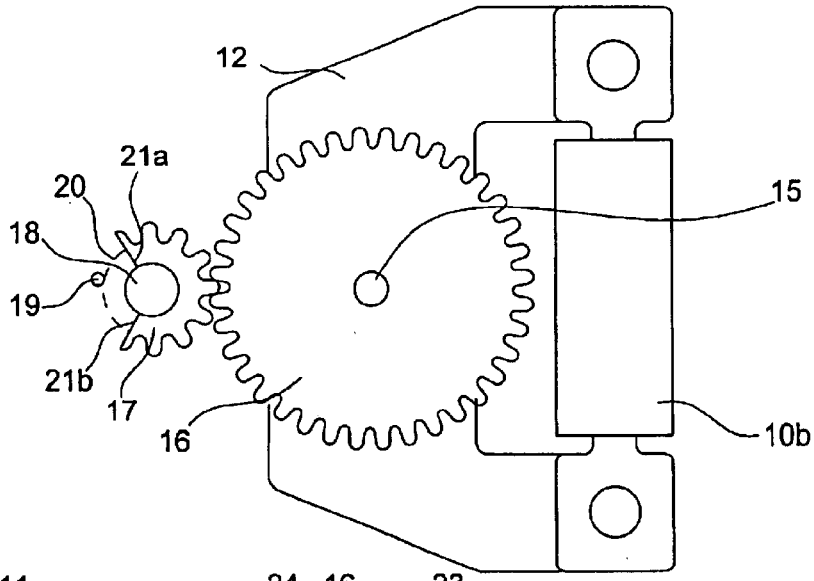

FIG. 4B shows the drive mechanism preferably used with actuator 10 of FIG. 4A. The rotor, not visible in this FIG. 4B, is mounted on shaft 15, the latter defining, with the toothed drive wheel 16, a drive wheel set for the power reserve indicator member. As will be shown with reference to FIGS. 6A to 6C, since the useful power reserve indication angle is of the order of 60°, there is advantageously provided a gear reduction wheel set formed by a toothed gear reduction wheel 17 meshed with drive wheel 16 and mounted on a shaft 18 driving the analogue power reserve indication member shown in FIG. 5. There is advantageously a ratio of 2 or 3 between the number of teeth of drive wheel 16 and that of gear reduction wheel 17, which allows the angle to be increased in order to display the power reserve provided, for a useful angle of 60°, a display angle respectively of approximately 120° or 180° is available.

In order to prevent the power reserve indicator member being moved outside the display angle, for example because of a shock, or excessive manipulation of the winding mechanism, means for blocking the indicator member are provided. For this purpose, a gear reduction wheel 17 having a hollowed sector 20 is preferably used, defining first and second support surfaces 21*a* and 21*b* for co-operating with a single stop member 19. Advantageously, this hollowed sector 20 has an angle at centre of 120°. The two end positions for which support surfaces 21*a* and 21*b* are in contact with stop member 19, correspond to the two end positions of the power reserve indicator member, i.e. a first position corresponding to the spring being wound and a second position corresponding to the spring being let down.

It is to be noted that other stop devices can be provided, particularly in the form of studs placed on either side of the display angle located on the dial of the timepiece.

Figure 5:
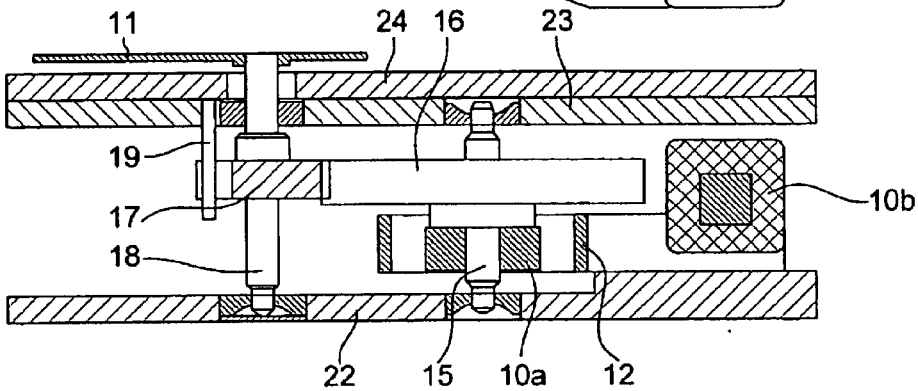
FIG. 5 shows a cross-section of an indicator device according to an advantageous embodiment of the invention.

FIG. 5 shows a cross-section of the whole of the power reserve indicator device according to the embodiment shown in FIGS. 4A and 4B. Plate 22 acts as a support particularly for stator 12 and coil 10*b* and for shafts 15 and 18 on which the toothed drive and gear reduction wheels 16 and 17 are respectively mounted. An upper bridge 23 enables the stop member 19 to be secured. A recess made in the upper bridge and in the timepiece dial 24 allows shaft 18 to pass, on which an analogue power reserve indication member 11, typically a hand moving facing suitable scales, is mounted. Of course, the use of a disc providing an indication through an aperture can also be provided, or any other appropriate analogue display means.

Figure 6A:
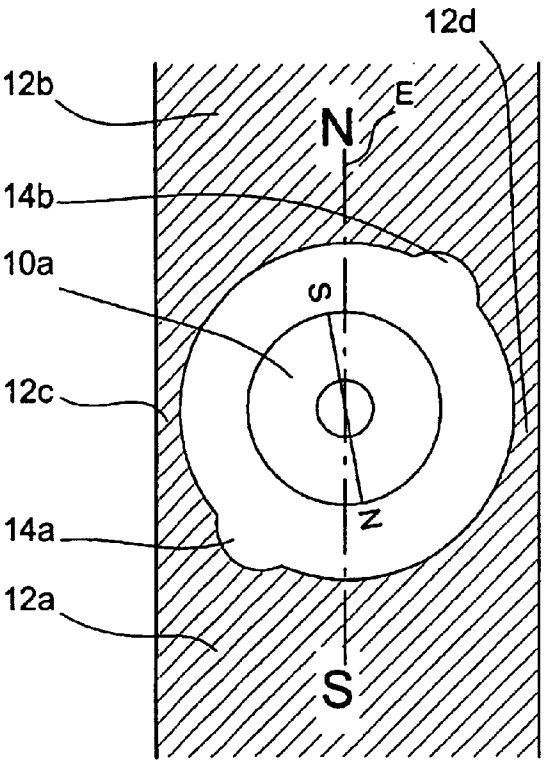
FIGS. 6A, 6B and 6C show the movement of the magnetised rotor used in the actuating means as a function of the winding of the spring.
Figure 6B:
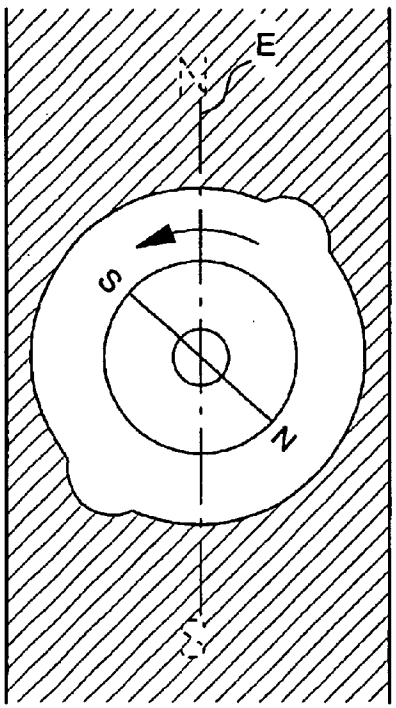
Figure 6C:
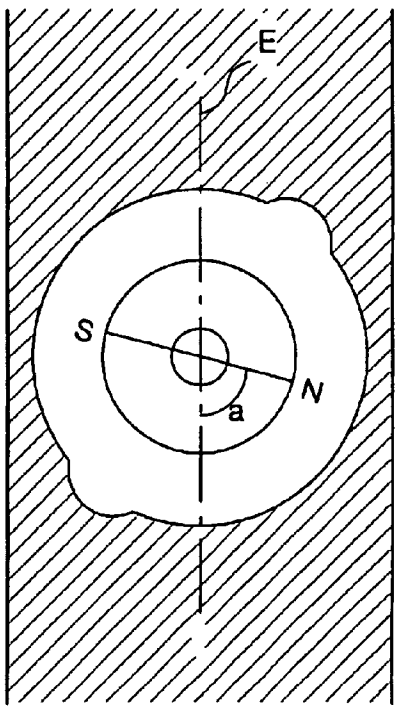

FIGS. 6A, 6B and 6C show the movement of the magnetised rotor with respect to the stator as a function of the winding of the spring housed in the barrel of the timepiece. This movement corresponds to the changing position of magnetic equilibrium defined by the opposition between the mean magnetic coupling existing between the stator (12) and the rotor due to the electric quantity transmitted during the braking periods and the positioning torque or couple existing between the stator and the rotor due to the geometry of the stator, the latter being of high magnetic permeability.

FIG. 6A corresponds to the initial position of magnetised rotor 10*a* when the spring is completely wound. The generator is then frequently braked by the switching means in order to reduce its operating frequency to the reference frequency. During the braking periods, coil 10*b* is electrically coupled to coil 2*b* of the generator, which generates a magnetic field through stator 12. The resulting mean induced magnetic field allows the stator to be assimilated with a magnetic dipole, a first stator portion 12*a* of which corresponds, for example to the magnetic north pole N, and a second stator portion to the magnetic south pole S.

In this case, the N pole of stator portion 12*a* attracts the S pole of magnetised rotor 10*a*. The positioning of which torque opposes this magnetic torque between the stator and rotor, the effect is to attract magnetised rotor 10*a* to its idle position shown in FIG. 6C. The position of the rotor is given by the position of magnetic equilibrium.

FIG. 6B shows an intermediate position in which the spring is no longer completely wound. The braking applied to the generator is then less frequent and the mean magnetic dipole of the stator is less significant. Thus, the position of magnetic equilibrium of magnetised rotor 10*a* is between the initial position defined in FIG. 6A and the idle position defined in FIG. 6C. The rotor rotates in the direction indicated by the arrow.

FIG. 6C shows, as was mentioned hereinbefore, the idle position of magnetised rotor 10*a*, i.e. the position in which the generator is no longer braked, when the spring is let down or when the generator is no longer in a position to operate at the reference frequency.

In this case, the magnetic torque between the stator and the rotor is zero and thus the position of magnetic equilibrium of the rotor no longer depends only upon the positioning torque, the rotor then being in its idle position depending on the geometry of the stator. For this purpose, the stator has constricted zones of material 12*c* and 12*d* and necks 14*a* and 14*b* made on the periphery of circular cavity 13. The idle position thus forms an angle (a) of approximately 80° between axis E of the stator and the north-south axis (N-S) of the magnetised rotor.

It will be noted on this occasion that, in reality, there are two idle positions, that shown and the opposite polarity position, i.e. offset angularly by 180°. The magnet is thus arbitrarily placed in the position shown when the power reserve indicator device is assembled.

By way of additional comments, it will be noted that it has been demonstrated that the analogue power reserve indicator member gives information as to the age of the oil used for the timepiece movement, particularly as regards the gear trains, this member no longer indicating maximum reserve when the spring is completely wound. Advantageously, this member will thus also be used as an indicator of the aging of oils for the purpose of replacing them.

It is also to be noted that a viscous oil is advantageously used for the indicator device in order to increase its stability.

Moreover, it should be noted that the generator provided preferably corresponds to that defined in FIG. 1 of EP Patent No. 1 109 083 file in the name of the present Applicant, incorporated herein by reference. Such a generator includes a rotor having two flanges arranged on either side of three flat series-connected coils, forming the stator and substantially offset by 120° from each other relative to the axis of the rotor in the same orthogonal plane to the latter. Six magnets are fixed radially and at regular intervals on each flange, facing the coils. The polarity of two consecutive or opposite magnets is opposite.

It will be noted in this regard that it is possible to provide other embodiments of the generator, in particular a generator mechanically coupled to the barrel spring so as to generate a movement of oscillation at a frequency enslaved by means of the regulator circuit.

It will be noted, finally, that other embodiments of the actuating means can be provided, in particular in accordance with the two variants presented hereinafter.

According to a first variant, the actuating means include in particular a coil connected, via switching means, for example those of FIG. 2, to the generator coil(s) at the time of the braking periods, in which a ferromagnetic body is arranged, like for example an iron-nickel alloy or a combination of alloys of the steel-brass type. At the time of the braking periods, the coil is powered via an electric quantity transmitted by the generator, dependent on the power reserve. The induced magnetic field, dependent on this electric quantity, and thus on the power reserve, has the effect of deforming the ferromagnetic body by magnetostriction. This deformation of the ferromagnetic body is used to indicate the power reserve by any appropriate mechanical means.

According to a second variant, the actuating means include, in particular, a wire formed of a shape memory alloy series-connected to the generator coil(s) at the time of the generator braking periods. A shape memory alloy can acquire two different shapes, a high temperature shape and a low temperature shape, these two shapes being imposed by the electric quantity transmitted at the time of braking periods, which has the effect of increasing the temperature of said wire formed of an alloy of this type. The most commonly used alloys are CuZnAl, TiNi and CuAlNi. It is to be noted that, advantageously, the addition of beryllium in the CuAl alloys allows considerably lower transformation temperatures to be obtained, while ensuring good stability at high temperatures.

What is claimed is:

1. A timepiece including a barrel, a spring housed in said barrel, time display members mechanically coupled to said barrel, an electric energy generator also coupled to said barrel, and a regulator circuit for enslaving the frequency of said generator to a reference frequency, said regulator circuit including for this purpose switching means arranged for electrically braking said generator during braking periods, when said regulator circuit detects that the frequency of said generator is higher than the reference frequency, wherein said generator controls actuating means of an analogue power reserve display member, via an electric quantity transmitted by electric coupling between said actuating means and said generator, during said braking periods.

2. The timepiece according to claim 1, wherein said actuating means of said power reserve display member are arranged so as to move said display member from a first position corresponding to the spring being wound to a second position corresponding to the spring being let down.

3. The timepiece according to claim 1, wherein the generator includes at least one coil and wherein said actuating means include an additional coil, said electric coupling between said actuating means and said generator being achieved by said switching means arranged for electrically coupling said coils at the time of said braking periods.

4. The timepiece according to claim 3, wherein said electric quantity is alternating, and wherein said switching means are switched so as to transmit a rectified electric quantity to said additional coil.

5. The timepiece according to claim 3, wherein the actuating means include an electrically controlled actuator formed by a stator including said additional coil and by a magnetised rotor, the latter being magnetically coupled to the stator and mechanically coupled to said analogue power reserve display member.

6. The timepiece according to claim 5, wherein the stator has a circular cavity on which are arranged two necks arranged such that the useful angle of the rotor corresponding to its rotating movement is approximately 60°.

7. The timepiece according to claim 5, wherein said rotor is coupled to said analogue power reserve display member via a gear reduction wheel set including a gear reduction wheel having a hollowed sector and wherein a stop member is arranged in said sector so as to limit the rotational angle of said wheel.

8. The timepiece according to claim 1, wherein a viscous oil is used to obtain a stable indication of the power reserve by said display member.

9. The timepiece according to claim 1, wherein said analogue power reserve display member also provides an indication as to the aging of oils of said timepiece, the first position being slightly offset.

10. A timepiece including a barrel, a spring housed in said barrel, time display members mechanically coupled to said barrel, an electric energy generator which includes at least one coil and which is also coupled to said barrel, and a regulator circuit for enslaving the frequency of said generator to a reference frequency, said regulator circuit including for this purpose switching means arranged for electrically braking said generator during braking periods, when said regulator circuit detects that the frequency of said generator is higher than the reference frequency, wherein said generator controls actuating means of an analogue power reserve member, via an electric quantity transmitted by electric coupling between an additional coil of said actuating means and said at least one coil of said generator, said electric coupling being achieved between said coils by said switching means at the time of said braking periods.

11. A timepiece including a barrel, a spring housed in said barrel, time display members mechanically coupled to said barrel, an electric energy generator which includes at least one coil and which is also coupled to said barrel, and a regulator circuit for enslaving the frequency of said generator to a reference frequency, said regulator circuit including for this purpose switching means arranged for electrically braking said generator during braking periods, when said regulator circuit detects that the frequency of said generator is higher than the reference frequency, wherein said generator controls actuating means of an analogue power reserve member, via an alternating electric quantity transmitted by electric coupling between an additional coil of said actuating means and said at least one coil of said generator, said electric coupling being achieved between said coils by said switching means at the time of said braking periods so as to transmit a rectified electric quantity to said additional coil.

* * * * *